US005695354A

United States Patent [19]

Noda

[11] Patent Number: 5,695,354

[45] Date of Patent: Dec. 9, 1997

[54] PRINTED CIRCUIT BOARD CONNECTOR

[75] Inventor: Atsuhito Noda, Hachiouji, Japan

[73] Assignee: Molex Incorporated, Lisle, Ill.

[21] Appl. No.: 774,710

[22] Filed: Jan. 3, 1997

Related U.S. Application Data

[63] Continuation of Ser. No. 561,508, Nov. 20, 1995, abandoned.

[30] Foreign Application Priority Data

Dec. 28, 1994 [JP] Japan ..... 6-338972

[51] Int. Cl.[6] ..... H01R 13/62

[52] U.S. Cl. ..... 439/326; 439/637

[58] Field of Search ..... 439/59–62, 326–329, 439/629–637

[56] References Cited

U.S. PATENT DOCUMENTS

| | | | |
|---|---|---|---|
| 4,619,495 | 10/1986 | Sochor . | |
| 4,747,790 | 5/1988 | Masuda et al. | 439/631 |
| 4,842,538 | 6/1989 | Noschese | 439/260 |
| 4,869,672 | 9/1989 | Andrews, Jr. | 439/60 |
| 5,110,309 | 5/1992 | Ichitsubo | 439/630 |
| 5,203,725 | 4/1993 | Brunker et al. | 439/636 |
| 5,378,175 | 1/1995 | Regnier | 439/733 |
| 5,393,234 | 2/1995 | Yamada et al. | 439/62 |
| 5,567,171 | 10/1996 | Mizuguchi | 439/326 |

FOREIGN PATENT DOCUMENTS

| | | | |
|---|---|---|---|
| 6-188045 | 7/1994 | Japan . | |
| 277169-A | 2/1984 | Taiwan | H01R 13/514 |
| 269753 | 3/1984 | Taiwan | H01R 23/68 |
| 1146514 | 3/1969 | United Kingdom . | |

OTHER PUBLICATIONS

72 Circuit Small Outline SIMM Proposal Drawing dated Sep. 16, 1993 and an attached cross sectional sketch.

Sales Assembly 1mm Pitch 278 CKT.Card Edge 1.27±0.13 THK.Module.

Hitachi Small Outline SIMM dated Feb. 1993.

AMP Socket Proposal for Small Outline SIMM pp. B–21–B–27.

Toshiba Corporation P25001001009, p. No. 5.

*Primary Examiner*—Khiem Nguyen

*Attorney, Agent, or Firm*—James C. Paschall

[57] ABSTRACT

A low profile, surface mount printed circuit card connector includes a housing having a longitudinal card receiving slot therein. The housing includes first and second terminal receiving cavities which are disposed in a staggered relationship on opposite sides of the slot first and second terminals are disposed in the cavities and include solder tail portions which extend out of the cavities for connection to a circuit board. The terminals further include contact portions which extend out of their respective cavities into the housing longitudinal slot.

18 Claims, 3 Drawing Sheets

PRINTED CIRCUIT BOARD CONNECTOR

This is a continuation of application Ser. No. 08/561,508, filed on Nov. 20, 1995 abandoned.

BACKGROUND OF THE INVENTION

The present invention relates generally to electrical connectors for printed circuit boards and, more particularly, to an improved low profile, surface mount connector which receives and mounts a printed circuit board in a plane above another circuit board, which connector has an overall reduced size and first and second sets of resilient terminals.

Circuit board connectors are widely used in the electrical arts. Such connectors are used to connect secondary printed circuit boards to primary circuit a boards. These connectors may support secondary circuit boards in different planes with respect to the primary circuit board. For example, a connector may support a secondary circuit board in a generally perpendicular orientation in a vertical plane or it may support the secondary circuit board in a parallel orientation in horizontal plane above the primary circuit board. The former connector requires more vertical space than the latter connector, and in view of the trend toward reduction in size of electronic devices, the latter style connector is gaining in popularity because it will reduce the overall height of the electronic component in which it is used. These types of connectors which engage a secondary circuit board and support it in a horizontal plane are often referred to in the art as "low profile" connectors.

One example of the latter style of connector is described in Japanese Laid-Open Patent Application No. 6-188045 and includes a rectangular housing having two sidewalls and an intermediate wall. A series of first terminals are located in the housing, each first terminal including: a stem section lying in contact with an upper surface of the intermediate wall, a solder tail section connected to the rear end of the stem section, an arm section having a rear end connected to a front end of the stem section and a contact section connected to the front end of the arm section. This connector further has a series of second terminals, each having: a stem section lying on an upper surface of the housing floor wall, a solder tail section connected to a rear end of the stem section, an arm section with a rear end connected to a front end of the stem section and a contact section connected to a front end of the arm section. The first and second terminals are independent of each other an define a longitudinal slot to hold secondary printed circuit board when inserted into the slot from an oblique, upward position and positively held between the sets of first and second terminals when the circuit board is rotated into a horizontal position.

The contact section of the terminal is formed from the arm section which extends from the stem section by first bending it downwardly to form a bent portion which extends rearwardly, secondly bending it to extend forwardly, thirdly bending it down obliquely and finally bending it up obliquely to form a contact point on the contact section. This structure may be characterized as a reentrant extension having first and second bent portions. This type of connector has a relatively increased size in its vertical dimensions because of the reentrant configuration of the set of first resilient terminals, which prevents reduction of the vertical dimensions of the connector below a specific threshold. As such, it is difficult to achieve low profile housings because of the need to form terminal contact portions by multiple folding of portions of the terminals.

Another electrical connector is known to have a set of first resilient terminals with contact sections extending forwardly from arm sections without being bent at all. Although this connector has a relatively decreased size because of the non-bent, substantially straight configuration of its first resilient terminals which permits a reduction in the connector size to a minimum, the first terminals do have a strong enough resilience to exert the desired contact pressure as opposing contact pods of a secondary printed circuit board.

Therefore, there exists a need for an electrical connector of reduced size with resilient terminals which provide sufficient contact pressure onto a secondary printed circuit board or card inserted into the connector.

The problems described above may be avoided by utilizing a connector which has a reduced vertical size and which has resilient terminals to apply sufficient contact pressure to contact traces on an insertable edge of a circuit card. The present invention overcomes the disadvantages of the prior art described above and provides benefits thereover by providing a surface mount connector having a longitudinal slot which receives the edge of a secondary circuit board therein and which includes sets of opposing first and second resilient terminals of reduced vertical dimension in order to cause sufficient contact pressure on each terminal contact portion when the secondary circuit board is inserted into the connector. Such a dimensional reduction is obtained without any corresponding loss in resiliency of the connector terminals by forming the terminals in such a manner so as to decrease their vertical dimensions as well as to improve their overall contact pressure on any circuit board inserted into the connector.

Accordingly, it is a general object of the present invention to provide a new and improved surface mount connector.

Another object of the present invention is to provide an electric connector for printed circuit boards using first resilient terminals of such a shape as permits reduction vertical connector size, still assuring good resilience to cause a good contact pressure on each contact when making an electric connection with a selected conductor in a printed circuit board.

SUMMARY OF THE INVENTION

The present invention is directed to an improved surface mount connector having a reduced vertical dimension and opposing rows of electrical terminals which reliably exert a sufficient contact pressure on a secondary circuit board held thereby which overcomes the shortcomings and disadvantages of the prior art.

To attain these objects, the present invention, in one principal aspect, includes a low profile electrical connector having a housing which includes a top wall, a floor wall and an intermediate wall extending therebetween with a rear wall connecting together the rear ends of the top wall, the intermediate wall and the floor wall. Two sets of opposing resilient terminals are held within housing of the connector in cavities extending along on opposite sides of the intermediate wall to define a slot therebetween which grips and contacts a secondary circuit board inserted therein. One set of these two terminal sets include a plurality of terminals each having a stem or body section lying on the upper surface of the intermediate wall, a solder tail section connected to the rear end of the stem section which extends out of the housing, an arm section connected to the stem section, and a contact section connected to the arm section.

In the second set of terminals, each terminal includes a stem section lying on the upper surface of the floor wall of the housing, a solder tail section connected to the stem section and extending out of the housing, an upwardly inclined arm section connected to the stem section, and a contact section connected to the front end of the forwardly inclined arm section. The first and second sets terminals are independent from each other and are staggered in a longitudinal direction along the housing to thereby define a longitudinal secondary circuit board-receiving slot therebetween. This slot engaged a printed circuit board inserted into the slot.

In another principal aspect of the invention, the solder tail section of each first resilient terminal includes a riser portion extending vertically along the rear surface of the rear wall of the housing and a surface mount portion which extends outwardly substantially flush with the bottom surface of the floor wall of the housing. Each contact section of these first terminals includes a rearwardly and downwardly portion extending from an arm section which is formed by bending the contact section (which is an extension of the arm section) rearwardly once. The second resilient terminals each include a solder tail section extending out from the stem section and away from the housing, an arm section connected to the stem section and a contact section having multiple bends therein upon itself.

The vertical dimensions of the terminal contact sections are reduced so that the overall vertical connector dimension may be accordingly reduced. The single folding of the first terminal contact sections upon themselves provides a good resilience to cause a good contact pressure when making an electric connection with a selected contact pad or trace on a printed circuit board.

These and other objects, features and advantages of the present invention will be clearly understood through a consideration of the following detailed description.

BRIEF DESCRIPTION OF THE DRAWINGS

In the course of the following detailed description reference will be made to the attached drawing wherein like reference numerals identify like parts and wherein.

DETAILED DESCRIPTION OF THE PREFERRED EMBODIMENTS

Figure 1:
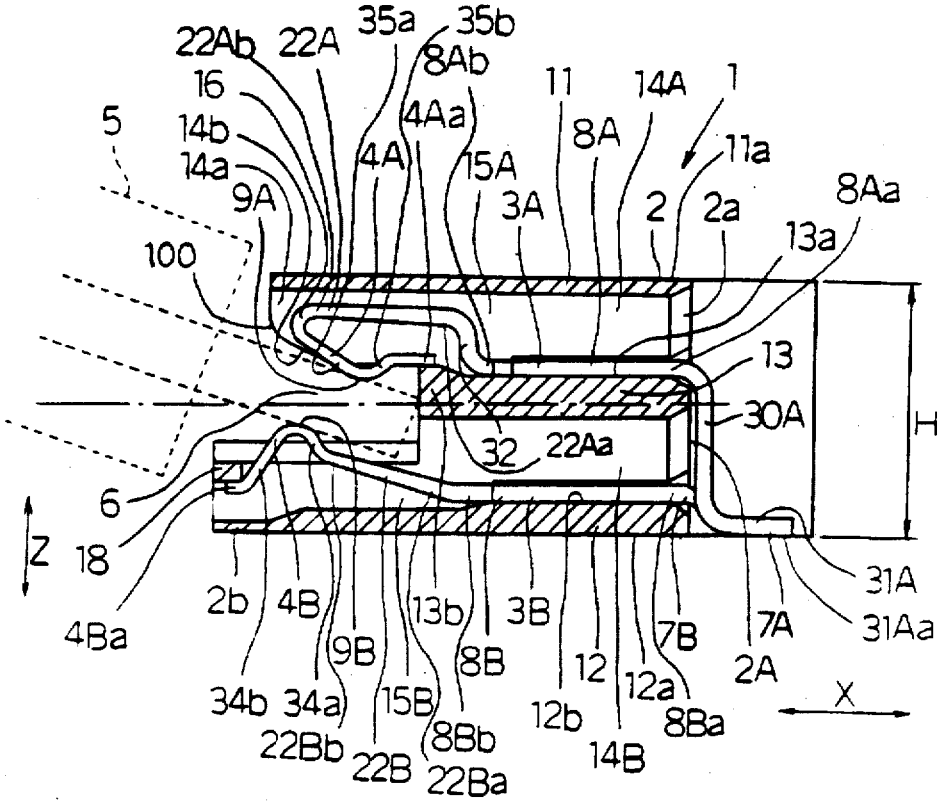
FIG. 1 is a cross sectional view of a first embodiment of an electric connector constructed in accordance with the principles of the according to the present invention, illustrating the insertion of a secondary printed circuit board, in phantom, into the electric connector.

FIGS. 1 to 5 illustrate a low profile, surface mount electrical connector constructed in accordance with the principles of the present invention. The connector 1 comprises an elongated housing 2 which contains sets of first and second resilient terminals 3A, 3B. The housing 2 is generally rectangular in cross section, (FIG. 3) and includes a top, or upper housing wall 11, a floor wall 12 and an intermediate wall 13 disposed therebetween. The housing includes a rear wall 2*a* interconnecting the rear ends of the top wall 11, the intermediate wall 13 and the floor wall 12. It will be understood that the terms "front" and "rear" as used in this description are primarily descriptive in nature and exemplary of the manner in which they are used in the art, with "front" referring to the side of the connector which the circuit board is inserted and "rear" referring to the side of the connector opposite the circuit board where the connector is attached to a primary circuit board.

Figure 4:
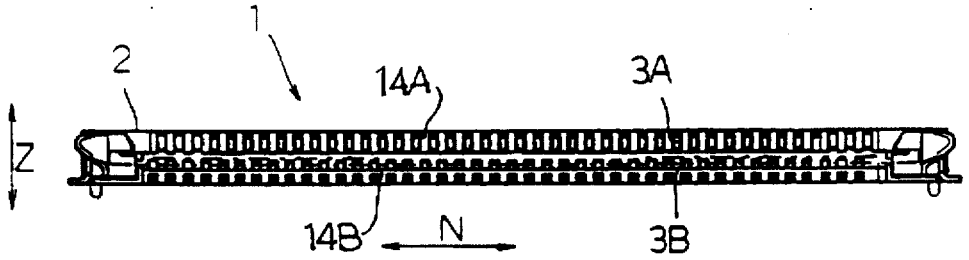
FIG. 4 is a front elevational view of the electric connector of FIG. 3.
Figure 5:
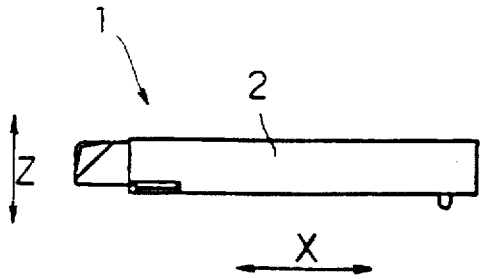
FIG. 5 is a side elevational view of the electric connector of FIG. 3.

The connector housing 2 has a longitudinal slot 6 generally centrally disposed between the opposing top and floor walls 11 & 12. This slot opens along the front of the connector housing 2 and permits the insertion and removal of a secondary printed circuit board 5. The longitudinal slot 6 extends longitudinally between the opposing ends of the connector 2 in the direction indicated by arrow N. A plurality of terminal-receiving cavities 15A, which accommodate the first terminals 3A are arranged at regular intervals in the longitudinal direction N along the upper level of the housing 2. These cavities 15A open on their front side into the slot 6 and are further partially defined by intervening partition walls 14A on opposite sides as illustrated in FIG. 4. Likewise, a plurality of second cavities 15B which accommodate the second resilient terminals 3B are arranged at regular intervals in the longitudinal direction N along the lower level of the housing 2 on the opposite side of the slot 6. These cavities 15B also open on their front side to the slot 6, and are at least partially defined by intervening partitions 14B on their opposite sides. Although FIG. 4 illustrates the upper and lower terminal-receiving cavities 15A and 15B in a staggered relationship, the cavities may be positioned within the housing in an aligned opposition with each other dependent on the position of the contact pads or traces formed on the secondary circuit board (not shown).

The upper partition walls 14A have a forward inclined section 100 ahead of the rearward rectangular section, thereby permitting the guiding of a printed circuit board 5 when it is inserted in the longitudinal slot 6 from an upper oblique position as illustrated in FIG. 1. The housing 2 has an overall vertical size or dimension indicated by H. The upper cavities 15A receive the first resilient metal terminals 3A while the lower cavities 15B receive the second metal resilient terminals 3B. These terminals will be typically gang loaded into the connector 2.

Figure 2:
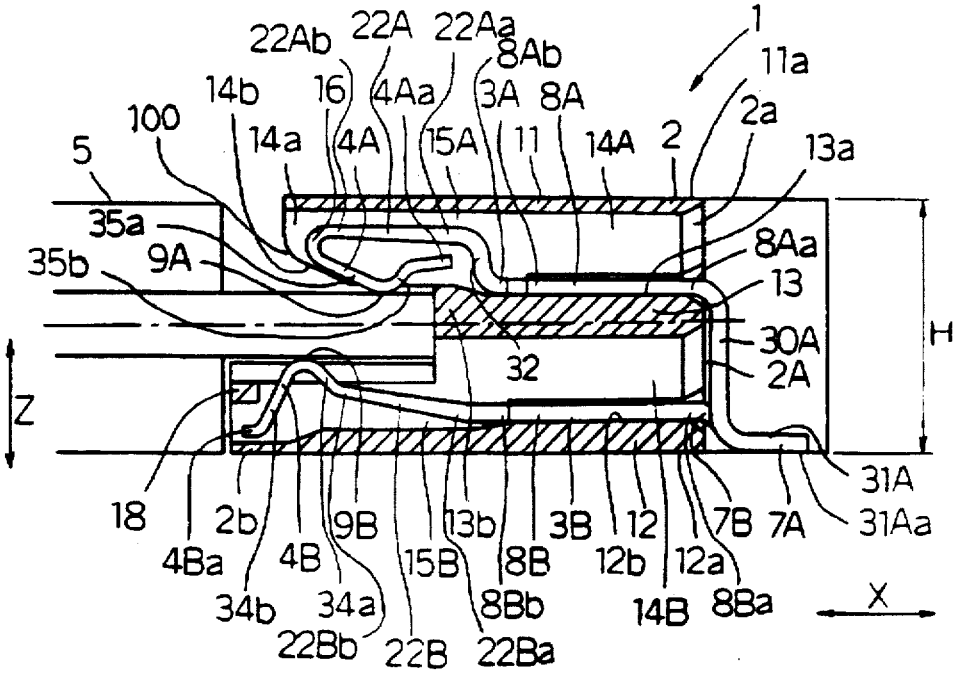
FIG. 2 is a cross sectional view of the connector of FIG. 1, illustrating the secondary printed circuit board in place within the electric connector.
Figure 3:
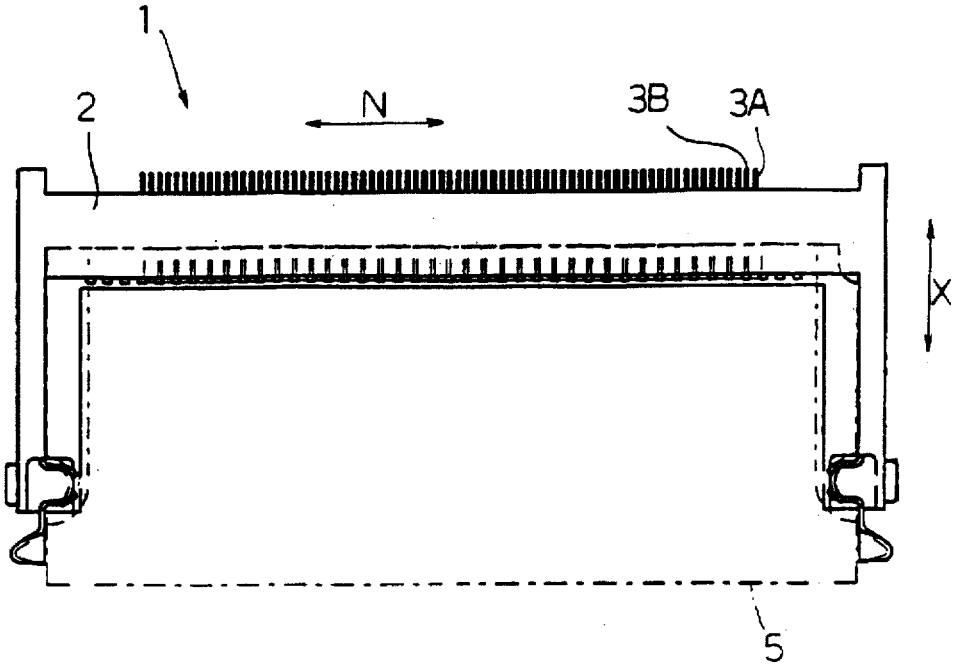
FIG. 3 is a plan view of the electric connector of FIG. 1.

Turning now to the specific structure of the terminals 3A & 3B, it can be seen that each first resilient terminal 3A of FIGS. 1 and 2 includes a terminal stem, or body section 8A, which lies upon on the upper surface 13*a* of the housing intermediate wall 13 and which is held by a portion of the housing 2, preferably the partition wall 14A. A solder tail section 7A connected to the rear end 8A*a* of the body section 8A extends out of the housing 2 as illustrated in FIGS. 1 and 2. An arm section 22A of the first terminal 2A has a rear end 22A*a* connected to the front end 8A*b* of the body section 8A and rises upwardly at 32 therefrom to define a cantilevered spring arm or spring beam portion (22A). Because of the reduced horizontal dimension of the connector 2, the spring arm 22A is not long enough to provide an effective spring rate by itself to the terminal 3A to ensure reliable contact with the circuit board 5.

Importantly, a contact section 4A is connected to the front end of the arm section 22A to form a portion with an effective spring rate of the terminal. In this regard, the terminal contact section 4A includes two inclined portions: a rearwardly and downwardly inclined portion 35*a* extending away from the spring arm portion 22A of the terminal and a rearwardly and upwardly inclined portion 35*b* extending from the end of the inclined portion 35*a*. These two inclined portions 35*a*, 35*b* meet via a contact point portion 9A. The contact section 4A is suitably formed by bending an extension of the arm section 22A once upon itself rearwardly at a frontal bent portion 16. This bending effects a preloading within the contact section 4A.

The contact section 4A further includes a tip portion 4A*a* which engages the front edge 13*b* of the housing intermediate wall 13, thus preventing any unregulated extension of the contact section 4A into the housing slot 6. The folded shape of the contact section 4A endows it with a good resilience so that the tip portion deflects inwardly (upwardly in FIG. 2) upon itself when the circuit board 5 is inserted into the connector slot 6. This point of the contact section deflection is remote from the contact point 9A of the terminal 3A. The folded shape of the contact section 4A reduces the overall thickness or height of the terminal spring arm 22A.

The solder tail section 7A of each first resilient terminal 3A includes a riser portion 30A extending in the vertical direction Z along the rear surface 2A of the rear wall 2*a* of the housing 2 and an end tip 31A extending away from the housing 2 and the lower end of the terminal solder tail riser portion 30A horizontally in the direction X. The lower surface 31A*a* of the solder tail tip portion 31A is preferably flush with the bottom surface 12*a* of the floor wall 12 of the housing 2.

It will be seen also from FIGS. 1 & 2 that each of the second resilient terminals 3B includes a stem or body section 8B, a solder tail section 7B, an inclined spring arm section 22B and a contact section 4B. The body section 8B lies on the upper surface 12i bof the floor wall 12 of the housing 2 and also partially trapped by the partition wall 14B. The solder tail section 7B has an end tip which extends from the rear end 8B*a* of the body section 8B horizontally in the direction X away from the housing 2. Preferably, the lower surface of the end tip lies flush with the bottom surface 12*a* of the housing floor wall 12 so that the solder tail section 7B and the first terminal solder tail section 7A are generally coplanar.

The inclined spring arm section 22B is connected to a forward end 8B*b* of the body section 8B on one side 22B*a* and rises forwardly and upwardly therefrom. Finally, the second terminal contact section 4B is connected to the front end of the inclined spring arm section 22B. The second terminal contact section 4B includes two inclined portions which are joined together: a forwardly and upwardly inclined portion 34 and a forwardly and downwardly inclined portion 34*b* extending from the end of the portion 34*a*. These portions 34*a*, 34*b* cooperate to define a contact portion 9B therebetween which is remote from the point of deflection 8B of the second terminal 3B to effect a preloading of the terminal 3B. The second terminal contact tip end 4B*a* engages a stop 18 located near the forward ends 14*c* of the lower partition walls 14B to prevent excessive rising of the contact section 4B due to the preload. The inclined spring arm section 22B thus endows the contact section 4B with required resilience in the vertical direction Z.

In inserting a printed circuit board 5 into the electrical connector 2, it can be seen that it is inserted from an upper, oblique position (FIG. 1) into the longitudinal slot 6 formed between both the housing top and floor walls 11, 12 and the longitudinal rows of the first and second resilient terminals 3A and 3B. The circuit board 5 is then rotating to a horizontal position in which it is positively held between the first and second resilient terminals 3A and 3B electrically connecting to selected conductors of the printed circuit. (FIG. 2.) This insertion causes the displacement or deflection of the free ends of the first and second terminal contact sections inwardly within their respective terminal-receiving cavities.

Figure 6:
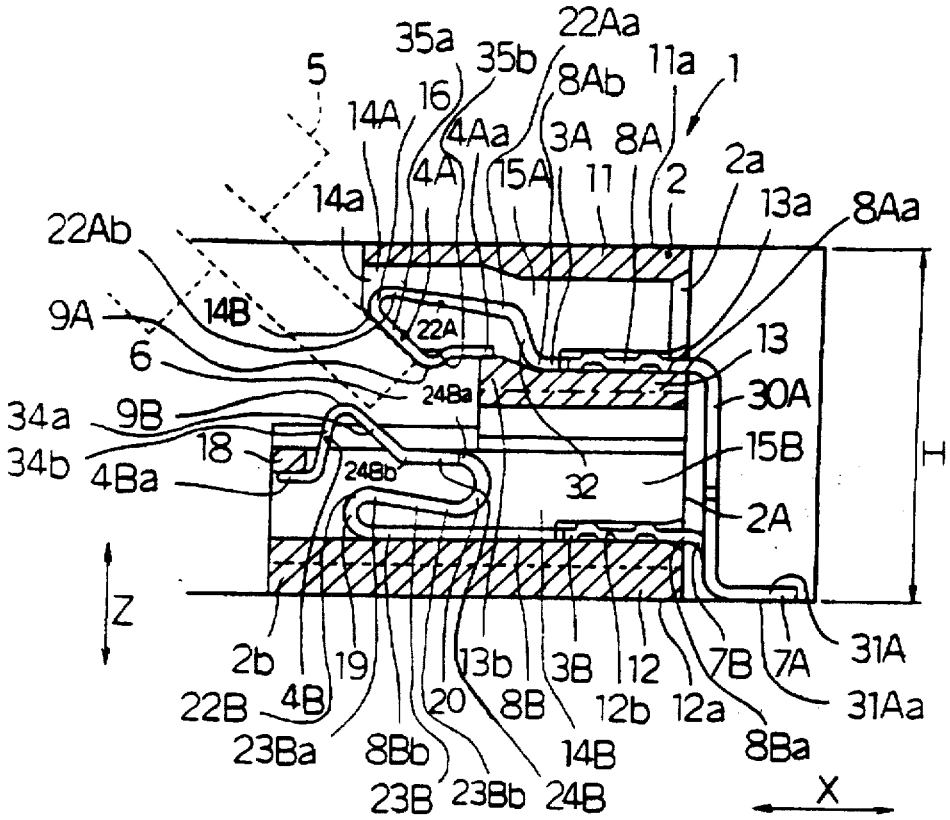
FIG. 6 is a cross sectional view of a second embodiment of an electric connector constructed in accordance with the principles of the according to the present invention, illustrating the insertion of a secondary printed circuit board, in phantom, into the electric connector; and, FIG. 7 is a cross sectional view of the connector of FIG. 6, illustrating the secondary printed circuit board in place within the electric connector.
Figure 7:
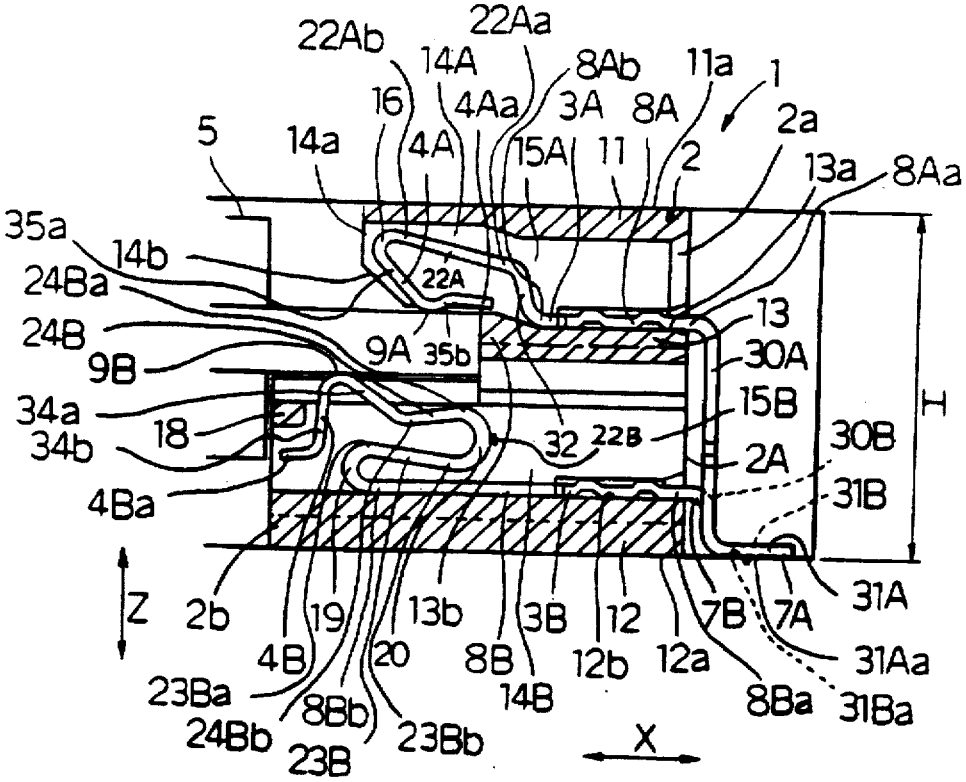

FIGS. 6 and 7 illustrate a second embodiment of an electrical connector constructed in accordance with the principles of the present invention. It differs from the first embodiment primarily with respect to the configuration of the second terminals. The first resilient terminal 3A of this embodiment also includes a solder tail portion 30A, a body portion 8A partially held along the upper surface 13*a* of the housing intermediate wall 13 by the intervening partition wall 14A as shown, a cantilevered spring arm portion 22A and a folded contact portion 4A. The first terminal body portion 8A may include as shown, indentations, which engage the intermediate wall and wall 14A of the housing.

The soldering tail section 7B of the second resilient terminal 3B (that illustrated in FIG. 6 as occupying the lower portion of the housing) includes a riser portion 30B extending along the rear surface 2*a* of the rear wall 2A of the housing 2 in the vertical direction Z. The riser portion 30B terminates in a tip portion 31B extending horizontally in the direction X away from the housing 2. The lower surface 31B*a* of the solder tail tip portion 31B is preferably flush with the bottom surface 12*a* of the housing floor wall 12.

The spring arm section 22B (FIG. 6) of the second resilient terminal 3B takes the form of a semi-bellows and includes a first spring arm section 23B connected to the forward end 8B*b* of the terminal body section 8B on one end 23B*a* of the spring arm section 23B. This is formed by bending the extension of the stem 8B rearwardly upon itself at bent end portion 19. The body section 8B of this terminal also may include indentations to engage the housing floor wall 12 and partition wall 15B as opposed to the lateral press fit characteristics of the first and second terminals of the first connector embodiment described above.

A second spring arm section 24B extends from the first spring arm section 23B forwardly upon itself at bent portion 20. The second terminal contact section 4B includes forwardly and upwardly inclined portion 34*a* connected to the other end 24B*b* of the second spring arm section 24B and a forwardly and downwardly portion 34*b* connected to the portion 34*a* which cooperate together to define contact point 9B. The reentrant shape of the spring arm section 22B endows the second terminal contact section 4B with required resilience in the vertical direction Z.

As may be understood from the above, an electric connector according to the present invention has first single-folded terminals, thereby reducing the vertical connector size, compared with the conventional electric connector having first double-folded terminals, yet still assuring good contact pressure against a printed circuit board.

While the particular embodiments of the invention have been described above, it will be apparent to those skilled in the art that changes and modifications may be made therein without departing from the invention in its broader aspects, and, therefore, the aim of the appended claims is to cover all such changes and modifications as fall within the true spirit and scope of the invention.

I claim:

1. A low profile electrical connector for establishing a connection between a primary circuit board to which the connector is mounted and a secondary circuit board inserted into said connector, comprising:

an insulative housing having a longitudinal slot disposed therein for receiving an edge of the secondary circuit board therein, the housing including opposing first and second sidewalls, said housing further having an intermediate wall disposed therein between said first and second sidewalls, said housing further having a plurality of terminal-receiving cavities disposed therein oriented generally transversely to said slot, said cavities including a series of first terminal-receiving cavities disposed on one side of said slot and in communication with said first sidewall and a row of second terminal-receiving cavities disposed on the opposite side of said slot and in communication with said second sidewall, said intermediate wall defining a portion of said slot, said connector further including a plurality of first and second stamped and formed metal terminals respectively disposed in said first and second terminal-receiving cavities such that each of said first terminal-receiving cavities receives a first terminal therein and each of said second terminal-receiving cavities receives a second terminal therein;

each first terminal including an elongated body portion which is held adjacent said intermediate wall by a portion of said housing, each first terminal being at least partially engaged within said first terminal-receiving cavity, a solder tail portion extending from said body portion out of said first terminal-receiving cavity away from said housing, a rise portion extending upwardly from said body portion, a spring arm portion extending from said rise portion and a contact portion biased by and extending from said spring arm portion toward said slot and folded back upon said spring arm portion, the contact portion having a contact point remote from said spring arm portion and extending into said slot;

each of said second terminals including an elongated body portion disposed adjacent said second sidewall and which is at least partially engaged within said second terminal-receiving cavity by a portion of said housing, a solder tail portion extending from said body portion out of said second terminal-receiving cavity away from said housing and a spring arm portion extending from said body portion toward said housing slot, the spring arm portion including a contact portion biased into said slot by said spring arm portion.

2. The connector as defined in claim 1, wherein said housing intermediate wall separates said first and second rows of terminal-receiving cavities.

3. The connector as defined in claim 1, wherein each of said second terminal contact portions further include a free end portion and each of said second terminal-receiving cavities includes a stop which engages the second terminal free end portions, and said first terminal contact portions further include a free end portion and said housing intermediate wall having a surface which engages said first terminal free end portions, said first and second terminal spring arm portions effectively preloading their respective first and second terminal contact portion toward said housing slot, said second terminal-receiving cavity stops and said intermediate wall limiting the extent to which said first and second terminal contact points extend into said housing slot.

4. The connector as defined in claim 1, wherein said second terminal spring arm includes a multiple-folded portion intermediate said second terminal contact and body portions.

5. The connector as defined in claim 1, wherein said spring arm portion of said first terminal is disposed adjacent said first wall of said housing.

6. The connector as defined in claim 1, wherein said rise portion of said spring arm portion of said first terminal is orthogonal to said body portion and wherein said second terminal spring arm includes a multiple-folded portion intermediate said second terminal contact and body portions.

7. The connector as defined in claim 1, wherein said first and second terminal solder tail portions include engagement portions which are generally coplanar.

8. The connector as defined in claim 1, wherein said first and second terminal-receiving cavities are staggered with respect to each other along said housing slot.

9. The connector as defined in claim 1, wherein said first and second terminals are stamped and formed from a resilient metal.

10. The connector as defined in claim 5, wherein said second terminal multiple-folded includes a U-shaped portion.

11. A surface mount, low profile electrical connector intended to receive the edge of a circuit board, the circuit board having opposing sides which extend along its edge, the connector comprising:

an insulative housing having opposing first and second sidewalls, the housing sidewalls defining a longitudinal slot which receives said circuit board edge therein, the housing slot having first and second rows of recesses disposed on opposite sides of said slot, first and second terminals respectively disposed in said first and second recesses, said housing slot and first and second terminals being of the type which receive said circuit board edge in an insertion position in which the plane of said circuit board is inclined with respect to said housing slot and in which said terminals are biased against said circuit board opposing sides when said circuit board is rotated to an engagement position in said connector, said first terminals each including a body portion held within said first recess, a solder tail portion extending from said body portion out of and away from said housing, a spring arm portion cantilevered out from said body portion, the spring arm portion including a deflectable contact portion folded back upon said spring arm portion to effect a preloading upon said contact portion, said contact portion having a free end, the free end engaging an intermediate wall to limit the extent of movement of said contact portion into said housing slot due to said preloading;

said second terminals each including a body portion held within said second recess, a solder tail portion extending from said body portion out of and away from said housing, a deflectable contact portion having a free end and a spring bellows portion extending from said body portion intermediate said contact portion and said body portion, the spring bellows portion being folded back upon said body portion to effect a preloading upon said contact portion, the contact portion free end engaging said second recess to limit the extent of movement of said contact portion into said housing slot due to said preloading.

12. The electrical connector defined in claim 11, wherein said second terminal spring bellows portion includes a U-shaped fold.

13. The electrical connector defined in claim 11, wherein said first and second terminals are stamped and formed from a resilient metal.

14. The electrical connector defined in claim 11, wherein said first terminal contact portion includes an inclined portion intermediate said first terminal contact free end and spring arm portions and said second terminal contact portion includes an inclined portion intermediate said second terminal contact free end and spring bellows portions, said first and second terminal inclined portion being generally parallel to each other prior to insertion of a circuit board into said housing slot.

15. The electrical connector defined in claim 11, wherein said first and second terminal contact free ends are disposed in different planes within said housing slot.

16. A low profile, surface mount electrical connector for receiving an edge of a circuit card, the circuit card having opposing sides which extend along its edge, the connector comprising:

an elongated housing having opposing first and second sidewalls, the housing sidewalls defining a longitudinal slot of said connector for receiving said circuit card edge therein, the housing slot having first and second rows of recesses disposed on opposite sides of said slot, first and second terminals respectively disposed in said first and second recesses, said first and second terminals cooperating to define a portion of said housing slot, said first and second terminals partially deflecting into their respective first and second recesses when said circuit card is inserted into said slot and rotated to an engagement position in which the plane of said circuit board is coplanar with respect to said housing slot, said first and second terminals being biased against said circuit card by a preloading imposed upon said terminals, each of said first terminals including a body portion held within said first recess, a solder tail portion extending from said body portion out of and away from said housing, a spring arm portion cantilevered out from said body portion, the spring arm portion including a deflectable contact portion folded back upon said spring arm portion to effect said preloading upon said contact portion, said contact portion having a free end;

said second terminals each including a body portion held within said second recess, a solder tail portion extending from said body portion out of and away from said housing, a spring arm portion and a deflectable contact portion extending from said spring arm portion, the spring arm portion being intermediate said contact and body portions, said spring arm portion extending away from said body portion in order to effect said preloading upon said contact portion, said contact portion including a contact point which extends into said housing slot.

17. The electrical connector as defined in claim 16, wherein the first terminal contact portion free end engages an intermediate wall so that said preloading of said first terminal urges a first terminal contact point into said housing slot and wherein a second terminal contact free end engages said second recess so that said preloading of said second terminal urges said second terminal contact point into said housing slot.

18. The electrical connector as defined in claim 16, wherein said second terminal spring arm portion includes a spring bellows portion.

* * * * *